United States Patent [19]

Connelly

[11] 4,450,633

[45] May 29, 1984

[54] CONVERTIBLE SHOE

[75] Inventor: Kathleen G. Connelly, Santurce

[73] Assignee: The Commonwealth of Puerto Rico, San Juan

[21] Appl. No.: 382,637

[22] Filed: May 27, 1982

[51] Int. Cl.[3] ..... A43B 3/24; A43B 11/00

[52] U.S. Cl. ..... 36/101; 36/50; 36/11.5

[58] Field of Search ..... 36/100, 101, 11.5, 57, 36/50

[56] References Cited

U.S. PATENT DOCUMENTS

| | | | |
|---|---|---|---|
| 2,368,314 | 1/1945 | Marx | 36/101 |
| 2,976,623 | 3/1961 | Gallaway | 36/100 |
| 3,678,604 | 7/1972 | Levine | 36/11.5 |
| 3,983,642 | 10/1976 | Liao | 36/101 |
| 4,308,672 | 1/1982 | Antonious | 36/50 |

FOREIGN PATENT DOCUMENTS

| | | | |
|---|---|---|---|
| 512041 | 8/1939 | United Kingdom | 36/100 |

*Primary Examiner*—Patrick D. Lawson

*Attorney, Agent, or Firm*—Scrivener, Clarke, Scrivener and Johnson

[57] ABSTRACT

A convertible shoe having a sole and releasable upper strap portions. Anchoring means attached to the sole edge cooperate with ring means at the ends of the strap portions to releasable secure the upper and sole portions.

1 Claim, 5 Drawing Figures

CONVERTIBLE SHOE

SUMMARY OF THE INVENTION

An assembly of parts which together form a shoe comprise a sole adapted to be attached to the foot by any one of a plurality of pairs of differently colored, styled or textured straps which are adapted to be positioned at the front part of the foot and connected to the sole by releasable means whereby the straps may be changed, for example to match other clothes worn by the wearer.

DESCRIPTION OF THE INVENTION

It is often desirable that shoes which are worn match the color, style, texture or other characteristic of the dress or suit which is also being worn, and in order to permit this it is usually necessary to wear shoes of different colors, textures or styles in order to achieve a matching effect.

By the present invention I have provided means whereby a single pair of soles may have associated with it a plurality of pairs of differently colored straps for releasably connecting the soles to the feet, the straps of each pair being of different color, texture or style from those of the other pairs so that by changing and interchanging the straps with a single pair of sides the visual parts of the shoes may be made to match the color, style or texture of the clothing which is being worn.

Figure 1:
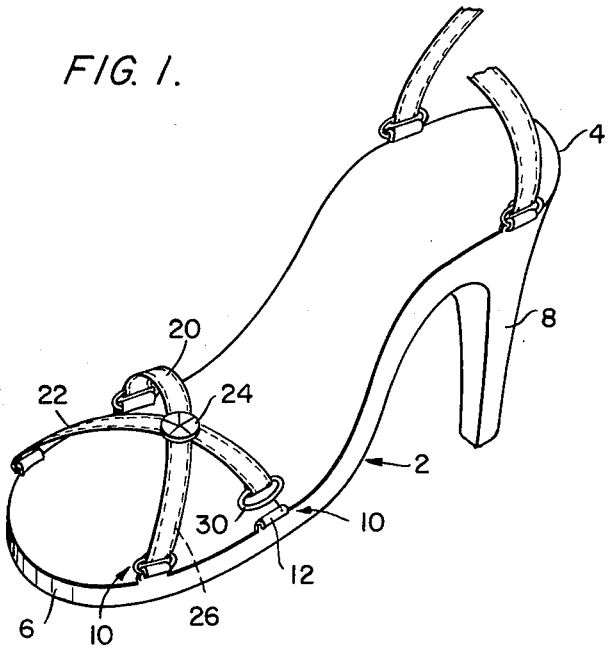
FIG. 1 is a perspective view of a shoe showing one embodiment by the means provided by the invention for releasably attaching the sole to the foot.

A first embodiment of the invention is disclosed in FIG. 1 of the drawings, in which there is disclosed the sole 2 of a shoe which, as is usual, comprises a heel part 4 and a toe part 6 which are integrally connected to provide a platform underlying the entire foot of a wearer. A supporting heel 8 may be provided under the heel part 4, if desired, and it will also be understood that the means provided by the invention do not require that the sole, as that term is used in the claims, underlie the entire foot.

Means are provided for attaching the sole to the foot of the wearer, and this is usually accomplished by means located at the toe and heel parts of the sole. In the embodiment of the invention disclosed in FIG. 1 the means for accomplishing this comprise, first, two anchoring means 10 which are positioned in longitudinally spaced relation on both sides of the toe part of the sole and each of which comprises a generally cylindrical part 12 extending longitudinally of the sole and protruding from its upper side edge and preferably formed integrally with the sole, as by molding, each of these anchoring means being aligned transversely of the sole with a corresponding anchoring means on the other side of the sole. Associated with the sole having these anchoring means there is provided means for releasably connecting the sole to the foot, each of which comprises two elongated straps 20, 22 which are arranged in crossed relation and connected at their center points 24, and each of which is stiffened by one or more internal wires 26 which extend longitudinally of each strap. A plurality of pairs of these crossed straps are provided in accordance with the invention, and each pair provides means for connecting two soles to the feet of a wearer, and the straps of each such pair are colored, textured or styled differently from the straps of other pairs.

In the embodiment of the invention being described each of the straps of each pair has at each of its ends an elongated open, generally oval-shaped loop 30 which is held to the end of the strap by passing the end of the strap through the loop and back onto the strap where is may be connected to the main body of the strap by any suitable means such as Velcro attachments 32. Each of the loops is of such size and configuration that it may be passed over the cylindrical part 12 of one of the attaching means 10 where it will be held under the lip of the part 12 of the connecting means, whereby the ends of the two crossed straps will be firmly connected to the sole but may be easily released from the sole in order to substitute straps of one color texture or style for those of another color, texture or style. As illustrated in FIG. 1, one or more straps may be provided at the heel end of the shoe, and connecting means of the described construction and arrangement may be provided for connecting these heels straps to the sole.

Figure 2:
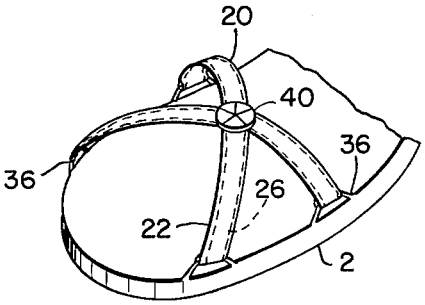
FIG. 2 is a view similar to FIG. 1 showing a second embodiment of the invention.
Figure 3:
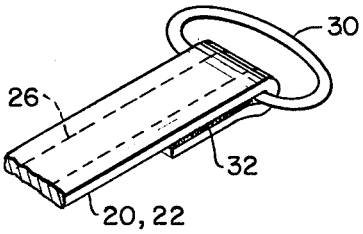
FIG. 3 is a perspective view of the end of each of the straps shown in FIG. 1.
Figure 4:
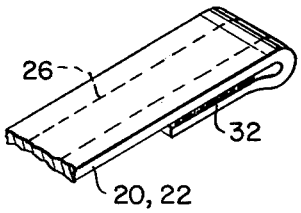
FIG. 4 is a perspective view of the end of each of the straps shown in FIG. 2.

A second embodiment in the invention is disclosed in FIG. 2 and it will be seen that in this form of the invention two spaced loops 36 are provided at each side edge of the toe end of the sole, each loop comprising an upwardly bowed part which provides an opening for the reception of the looped end of one of the straps 20, 22 of a pair of crossed straps which, in accordance with the invention, may be differently colored, textured or styled and which may have a jewelry ornament 40 positioned at the juncture of the straps and which may form the connection between them. Each strap may be connected to the sole by passing each of its ends through the opening of loop 36 and then folding the end back into the strap for connection by suitable means such as the Velcro connections 32.

Figure 5:
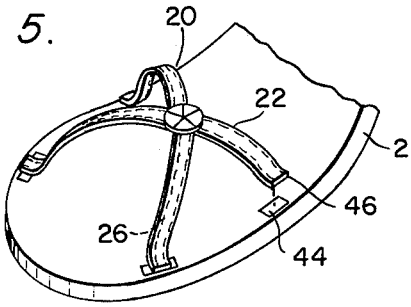
FIG. 5 is a perspective view showing a further embodiment of the invention.

A still further form which the invention may take, and which is particularly designed and intended for doll's shoes is disclosed in FIG. 5 in which the usual sole is partially shown at 2. The attaching means in this embodiment comprises, first, two permanent magnets 44 which are embedded in the sole in longitudinally spaced relation to each other along each side edge of the sole adjacent its toe end, and a permanent magnet 46 embedded in the end of each strap of a pair of crossed straps 20, 22.

In using the means provided by the invention any pair of crossed straps may be selected and used to attach soles to the feet of the wearer to assure match of the colors of the shoe with that of other clothes being worn.

I claim:

1. A shoe forming assembly comprising:

(a) a sole constructed and adapted to underlie the foot of a wearer, (b) means for releaseably connecting the sole to the foot of the wearer, comprising at least one anchoring means attached to a side edge of the sole adjacent the toe end and at least one strap having means on its end for releaseable connection to the sole-carried fastening means, (c) each anchoring means comprising a strip of rigid material which is elongated longitudinally of the sole having a first part connected to the edge wall of the sole, and a second part extending upwardly from the first part and curved outwardly of the sole from the first part, and (d) each strap having at its end a ring which is elongated in the direction of the sole and is sufficiently long to pass over the second part of the anchoring means and is formed of material of such diameter that it will be received below the outwardly curved part of the anchoring means.

* * * * *